US005390257A

United States Patent [19]

Oslac et al.

[11] Patent Number: 5,390,257

[45] Date of Patent: Feb. 14, 1995

[54] LIGHT-WEIGHT SPEAKER SYSTEM

[76] Inventors: Michael J. Oslac, Ste. 54E, 161 Chicago Ave. East, Chicago, Ill. 60611-2603; Harry J. Moskow, 5353 Monroe St., Skokie, Ill. 60077

[21] Appl. No.: 894,411

[22] Filed: Jun. 5, 1992

[51] Int. Cl.[6] ..... H04R 25/00

[52] U.S. Cl. ..... 381/199; 381/194; 381/204

[58] Field of Search ..... 381/199, 204, 169, 201, 381/194, 192; 181/151

[56] References Cited

U.S. PATENT DOCUMENTS

| | | | |
|---|---|---|---|
| 3,917,914 | 11/1975 | Parker | 381/204 |
| 3,937,904 | 2/1976 | Parker | 381/201 |
| 4,628,154 | 12/1986 | Kort | 381/199 |
| 4,657,108 | 4/1987 | Ward | 181/151 |
| 4,685,448 | 8/1987 | Shames et al. | 381/169 |

*Primary Examiner*—Forester W. Isen
*Assistant Examiner*—Sinh Tran

[57] ABSTRACT

Disclosed is a lightweight loudspeaker assembly comprising a high efficiency permanent magnet structure that is comprised of a rare earth metal magnet, preferably a neodymium-iron-boron magnet and an enclosure means for said permanent magnet comprised of a magnetic flux carrying material, such as steel. The magnet structure contains a small gap which accommodates a high impedance voice coil to which there is attached a cone diaphragm. The loudspeaker assembly contains a frame which supports the cone diaphragm and the permanent magnet structure. The frame is preferably comprised of a lightweight material, such as aluminum or magnesium or their alloys, a plastic material or a lightweight composite material. The loudspeaker assembly can optionally also contain a bucking magnet that is located in close proximity to the permanent magnet. Unconventionally, the bucking magnet is smaller in size and magnetic flux than the permanent magnet. The bucking magnet may be comprised of a magnetic material other than what is used in the permanent magnet structure. Optionally, the loudspeaker assembly can contain an integral resistor network, on a printed circuit board, which is in electrical communication with the voice coil.

27 Claims, 1 Drawing Sheet

LIGHT-WEIGHT SPEAKER SYSTEM

This invention relates to a light-weight speaker system that can be advantageously utilized in applications, such as in aircraft, where weight is an important consideration. More particularly, the invention relates to a lightweight loudspeaker assembly incorporating a high efficiency permanent magnet structure which is comprised of a rare earth metal or a rare earth metal composite permanent magnet, and most preferably a neodymium-iron-boron permanent magnet. The magnet structure contains a small gap that accommodates a voice coil which is attached to an adjacent cone diaphragm. The magnet structure also contains an enclosure means for the permanent magnet, such as a top plate and a bottom plate which are comprised of a magnetic flux carrying material. The enclosure means will at least sandwich, and will preferably substantially encapsulate, the permanent magnet. The loudspeaker assembly also contains a frame that supports at least the cone diaphragm and to which the permanent magnet structure is attached, with the frame being comprised of a lightweight material, preferably aluminum, magnesium, or their alloys, a plastic material, or a light-weight composite material.

BACKGROUND OF THE INVENTION

By and large, most present-day audio speakers employ a permanent magnet and a voice coil to drive a speaker in response to audio signals. Generally, today's dynamic loudspeaker consists of an electromagnetic transducer consisting in part of a voice coil, a cone diaphragm, and a magnet structure containing a small gap in which the voice coil moves. The magnet structure is designed to provide a strong magnetic field across the gap, so that when a current flows in the voice coil it will experience a force. As indicated, modern loudspeakers will typically employ high-efficiency permanent magnets.

The magnets used in these speakers are generally responsible for much of the weight of the speakers. High-quality speakers require substantial magnet systems and, in fact, many manufacturers routinely specify the magnet weight in their loudspeaker specifications.

Several different magnet systems are commonly employed in loudspeakers. The most common types of magnet systems utilized in loudspeakers consist of a cast magnet of a special magnetic alloy (for example, an alloy of aluminum, nickel, and cobalt) or a ceramic material. Such magnet systems are not generally light in weight, particular in view of the fact that typically magnetic flux is a direct function of magnet weight, and it is believed that the greater the magnetic flux, the greater the efficiency of the speaker.

Light weight loudspeakers which can reproduce sound with a high degree of fidelity are in demand. For example, there are ongoing efforts to safely reduce the weight of commercial airplanes in order to achieve increased fuel efficiency. Since a typical large commercial airplane will generally contain hundreds of loudspeakers, it would be advantageous to utilize lighter weight loudspeakers throughout the aircraft to effect a significant weight reduction.

One principal object, therefore, of the invention is to provide an improved light weight loudspeaker system.

Still another object of the invention is to provide a light weight loudspeaker system that produces high-quality sound reproduction.

SUMMARY OF THE INVENTION

These and other objects are realized by the present invention which is a lightweight loudspeaker assembly that comprises a high efficiency permanent magnet structure, which is comprised a rare earth metal magnet sandwiched, and preferably substantially encapsulated, by an enclosure means that is comprised of a magnetic flux carrying material, one typical example being steel. The loudspeaker assembly contains a voice coil to which a cone diaphragm is attached. Typically, a lightweight frame supports the cone diaphragm, with the permanent magnet structure being attached to the frame. The magnetic structure contains a small gap in which the voice coil moves.

BRIEF DESCRIPTION OF THE DRAWINGS

Like numerals in the drawings refer to similar elements.

DESCRIPTION OF THE INVENTION

Figure 1:
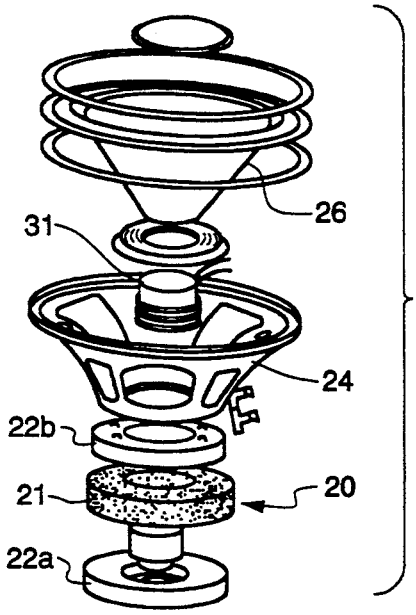
FIG. 1 is an exploded view of one embodiment of a loudspeaker assembly of the present invention.

With reference to FIG. 1, there is depicted a loudspeaker assembly shown generally as 10. Loudspeaker assembly 10 contains a permanent magnet structure, generally indicated as 20, which contains a permanent magnet 21 surrounded by an enclosure means 22, which in the depicted embodiment in FIG. 1 is comprised of bottom plate *22a* and top plate *22b* which sandwich permanent magnet 21. Permanent magnet structure 20 is attached to a frame 24 which supports a cone diaphragm 26. The loudspeaker also contains voice coil 31.

The permanent magnet utilized in the loudspeaker assembly of the present invention will be a high-efficiency, rare earth magnet, and preferably a rare-earth cobalt composite and most preferably a light rare earth ternary compound formed with boron and iron. Such rare-earth magnets, and in particular the light rare-earth ternary compounds, have greater magnetic energy per unit volume than the standard permanent magnetic material generally utilized in dynamic loudspeakers, thus permitting the use of lighter magnets in the loudspeaker assembly of the present invention. The magnet will be much smaller than magnets typically employed in commercial loudspeaker assemblies, and, in fact, will generally be one half the weight or less of such magnets. The preferred magnets for use in the present invention are high efficiency neodymium magnets, and in particular neodymium-iron-boron magnets. Samarium cobalt composites, which may contain substantial amounts of other materials such as iron, copper, zirconium, hafnium or titanium are another example of suitable rare earth magnetic materials for use in the present invention.

The enclosure means for the permanent magnet will be fabricated from a magnetic flux carrying material. Any magnetic material may be utilized in the construction of the enclosure means, including hybrid composite magnetic material. The preferred material for use in the enclosure means is steel, primarily because of its relatively low cost and its availability. For example, in the embodiment depicted in FIGS. 1 and 2, the enclosure means consists of two steel plates which generally serve to generally surround or "sandwich" the permanent magnet. However, in the preferred embodiment of the invention, the enclosure means for the permanent magnet can substantially encapsulate the permanent magnet in the manner depicted in FIG. 3, in which the enclosure means is in the form of a cap 25. Generally, this configuration can not be practically achieved when using the larger ceramic magnets. The configuration in which the enclosure means substantially encapsulates the permanent magnets typically can not be achieved in a practical fashion when using the larger ceramic magnets. This configuration is generally preferred in that it has been discovered that better results are achieved if the enclosure means substantially encapsulate the magnet as stray magnetic flux will be reduced and the efficiency of the magnetic circuit will be increased. For example, it has been discovered that when an NdFeB permanent magnet is encapsulated by steel the stray magnetic fields have been found to be extremely low and are not easily detected by standard means beyond about 25cm and, as a result, in aircraft installations will not cause magnetic interference with the equipment on board.

Figure 2:
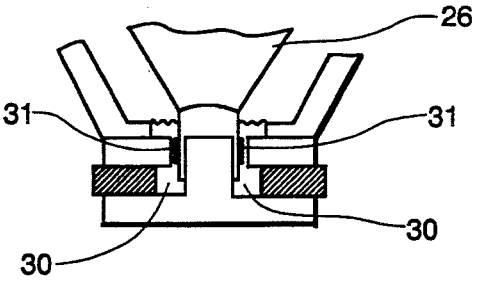
FIG. 2 is a partial sectional view of one embodiment of the permanent magnet structure of the present invention.

The permanent magnet structure contains at least one small gap 30, depicted in FIG. 2, that accommodates a voice coil 31 which is attached to and drives adjacent cone diaphragm 26. It is preferred that a high impedance voice coil be utilized in the loudspeaker apparatus of the present invention in order to eliminate the use of heavy transformers with the apparatus. The impedance of the high impedance voice coil is at least ten times greater than that of standard voice coils, whose impedance typically lie in the range of two to twenty ohms. Preferably, the impedance of the voice coil utilized in the present invention will range from about 20 ohms to about 10,000 ohms and most preferably the impedance of the voice coil will range from about 1000 ohms to about 2,000 ohms.

In order to achieve an additional weight reduction, the frame 24, which as indicated supports cone diaphragm 26 and to which the permanent magnet structure is attached, is comprised of a light-weight material which, for example, may be aluminum or magnesium or their alloys, plastic, reinforced plastic, or other lightweight materials.

Figure 3:
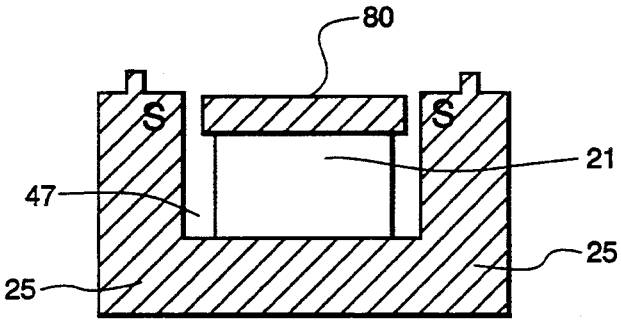
FIG. 3 is a partial sectional view of another embodiment of the permanent magnet structure of the present invention, in which the permanent magnet is substantially encapsulated by an enclosure means and a bucking magnet is employed.

In the preferred embodiment of the invention the permanent magnet structure may also include a bucking magnet. In FIG. 3, a bucking magnet 80 is shown positioned on the top of the permanent (main) magnet structure. Magnet 80 is referred to as a bucking magnet since its direction of polarity is opposed to that of the permanent magnet. The proper utilization of a bucking magnet has the effect of producing both a significant reduction in distortion and improving the sensitivity of a loudspeaker that does not use such a technique. In the prior art it was believed that, for a bucking magnet to significantly reduce distortion, it should be close in size and strength to the main magnet and, in fact, it was believed that it would be particularly desirable if the bucking magnet were larger than the main magnet with as much as, and often up to three to four times the magnetic strength of the main magnet. In addition, the bucking magnet was typically constructed from the same material as the main magnet. It has now been surprisingly discovered that, in the magnet structure of the present invention, a bucking magnet smaller in size and strength compared to the main magnet will yield significant benefits in both the reduction in distortion and the improvement of sensitivity when the main magnet is comprised of a rare-earth magnet material and, in particular, a neodymium-iron-boron magnet as compared to an identical loudspeaker assembly that does not employ such a bucking magnet. The bucking magnet may be attached to the back plate or portion of the magnet structure by any suitable means, such as by gluing. The bucking magnet of the present invention can be comprised of any suitable magnetic material, and may be comprised of a non-rare earth magnetic material. For example, in the loudspeaker apparatus of the present invention, a bucking magnet of inexpensive ferrite (ceramic) magnetic material may be placed in opposition to the rare-earth magnet to intensify the magnetic field by channeling stray flux into the voice coil gap.

Permanent magnet 21 is manufactured in any suitable shape, preferably rectilinear. Magnet 21 is positioned in an upright manner, the bottom of magnet 21 being received in recess 47. It is preferable that the contours of the size of recess 47 be close conformed to the size at the bottom of magnet 18.

Figure 4:
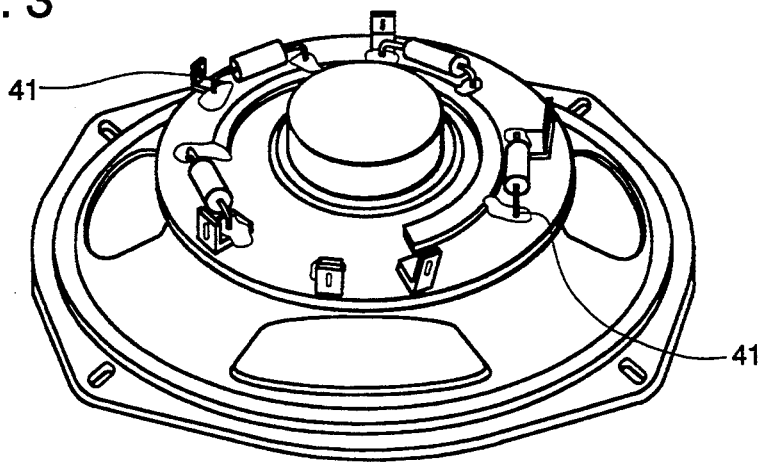
FIG. 4 is a partial sectional view of a further embodiment of the permanent magnet structure of the present invention.

FIG. 4 also depicts another optional aspect of the present invention in which there is an integral resistor network 41 on a printed circuit board that is built onto or otherwise attached to the loudspeaker apparatus of the present invention. The resistors are chosen to provide load limiting for different output/input power of the apparatus. A hold-down ring or snap ring-ring of metal, rubber, or plastic to hold the printed circuit board in place about the magnet assembly during manufacturing and use.

Electrical contact between the printed circuit board and the apparatus voice coil connections are made by means of a standard wrap-around terminal that is mechanically affixed to the apparatus frame and soldered or conductively glued to the printed circuit board.

An integral audio amplifier connected to the apparatus and built onto or into the frame of the apparatus. In many cases the amplifier may be built onto the printed circuit board that supports the resistor network, or it may be located elsewhere.

EXAMPLES

The following examples illustrate the advantageous use of a bucking magnet with a lightweight speaker constructed according to the present invention.

A lightweight 15 cm loudspeaker was constructed according to the present invention utilizing a neodymium-iron-boron permanent magnet and an aluminum alloy frame. In one example a ferrite bucking magnet was utilized which was smaller in size than the permanent magnet. The weight of the bucking magnet utilized was 11.1 g., and its use increased the weight of the loudspeaker by approximately 6%. However, it was discovered that the use of the bucking magnet increased the magnetic field strength of the loudspeaker by approximately 15% over an identically constructed loudspeaker in which the bucking magnet was not employed. In a second example, instead of a ferrite bucking magnet, a NdFeB bucking magnet was employed on an identical loudspeaker. The weight increase of the loudspeaker was only approximately 0.7%, but the magnetic field strength of the resulting magnet increased by approximately 15%.

What is claimed:

1. A lightweight loudspeaker assembly comprising:

a high efficiency permanent magnet structure containing a small gap that can accommodate a voice coil having an impedance ranging from about 1,000 to about 10,000 ohms, said magnet structure being comprised of a rare earth metal magnet and an enclosure means for said rare earth metal magnet, said enclosure means being comprised of a magnetic flux carrying material;

a cone diaphragm to which is attached the voice coil;

a frame supporting said cone diaphragm and said permanent magnet structure, said frame being comprised of a lightweight material.

2. The loudspeaker assembly of claim 1 wherein the enclosure means comprises a top plate and a bottom plate that in combination sandwich said rare earth metal magnet.

3. The loudspeaker assembly of claim 1 wherein the enclosure means substantially encapsulates said rare earth metal magnet.

4. The loudspeaker assembly of claim 1 wherein the frame is comprised of aluminum or magnesium or their alloys, a plastic material, or a light-weight composite material.

5. The loudspeaker assembly of claim 1 wherein said rare earth metal magnet is a neodymium-iron-boron magnet.

6. The loudspeaker assembly of claim 1 further comprising a bucking magnet that is located in close proximity to said rare earth metal magnet, said bucking magnet being smaller in size and magnetic strength than said rare earth metal magnet.

7. The loudspeaker assembly of claim 6 wherein the bucking magnet is comprised of a non-rare earth magnetic material.

8. The loudspeaker assembly of claim 7 wherein the bucking magnet is comprised of a ceramic material.

9. The loudspeaker assembly of claim 1 wherein the enclosure means is comprised of steel.

10. The loudspeaker assembly of claim 1 wherein the voice coil is a high impedance voice coil.

11. The loudspeaker assembly of claim 1 wherein the impedance of the voice coil ranges from about 1,000 ohms to about 2,000 ohms.

12. The loudspeaker assembly of claim 1 further comprising an integral resistor network on a printed circuit board, said resistor network being in electrical communication with the voice coil.

13. The loudspeaker assembly of claim 12 wherein the electrical contact between the resistor network and the printed circuit board is made by means of a wrap-around terminal.

14. A lightweight loudspeaker assembly comprising:

a high efficiency permanent magnet structure containing a small gap which accommodates a high impedance voice coil having an impedance ranging from about 1,000 to about 10,000 ohms, said magnet structure being comprised of a neodymium-iron-boron magnet and enclosure means for said neodymium-iron-boron-magnet, said enclosure means being comprised of steel;

a cone diaphragm to which is attached the voice coil;

a frame supporting said cone diaphragm and said permanent magnet structure, said frame being comprised of a lightweight material;

a bucking magnet that is located in close proximity to the neodymium-iron-boron magnet, said bucking magnet being smaller in size than said neodymium-iron-boron magnet and being comprised of a non-rare earth magnetic material; and an integral resistor network on a printed circuit board, said resistor network being in electrical communication with the voice coil.

15. The loudspeaker assembly of claim 14 wherein the frame is comprised of aluminum or magnesium or their alloys, a plastic material or a light-weight composite material.

16. The loudspeaker assembly of claim 14 wherein the bucking magnet is comprised of a ceramic material.

17. The loudspeaker assembly of claim 14 wherein the impedance of the voice coil ranges from about 1,000 ohms to about 2000 ohms.

18. The loudspeaker assembly of claim 14 wherein the neodymium-iron-boron magnet is substantially encapsulated by said enclosure means.

19. A lightweight loudspeaker assembly comprising:

a high efficiency permanent magnet structure containing a small gap which accommodates a high impedance voice coil having an impedance ranging from about 1,000 to about 10,000 ohms, said magnet structure being comprised of a neodymium-iron-boron magnet, and a steel enclosure means for said neodymium-iron-boron magnet;

a cone diaphragm to which is attached the voice coil;

a frame supporting said enclosure means, said cone diaphragm and said permanent magnet structure, said frame being comprised of a lightweight material; and a bucking magnet that is located in close proximity to the neodymium-iron-boron magnet, said bucking magnet being smaller in size than said neodymium-iron-boron magnet.

20. The loudspeaker assembly of claim 19 wherein said bucking magnet is comprised of a non-rare earth magnetic material.

21. The loudspeaker assembly of claim 20 wherein the bucking magnet is comprised of a ceramic material.

22. The loudspeaker assembly of claim 19 further comprising an integral resistor network on a printed circuit board, said resistor network being in electrical communication with the voice coil.

23. The loudspeaker assembly of claim 22 wherein the electrical contact between the resistor network and the printed circuit board is made by means of a wrap-around terminal.

24. The loudspeaker assembly of claim 19 wherein the frame is comprised of aluminum or magnesium or their alloys, a plastic material or a lightweight composite material.

25. The loudspeaker assembly of claim 19 wherein the impedance of the voice coil ranges from about 1,000 ohms to about 2000 ohms.

26. The loudspeaker assembly of claim 19 wherein the neodymium-iron-boron magnet is substantially encapsulated by said top and bottom plates.

27. A lightweight loudspeaker assembly comprising:

a high efficiency permanent magnet structure containing a small gap which accommodates a high impedance voice coil, said magnet structure being comprised of a neodymium-iron-boron magnet, and a steel enclosure means which substantially encapsulates said neodymium-iron-boron magnet;

a cone diaphragm to which is attached the voice coil;

a frame supporting said cone diaphragm and said permanent magnet structure, said frame being comprised of aluminum or magnesium or their alloys, a plastic material or a light-weight composite material; wherein the impedance of the voice coil ranges from about 1,000 ohms to about 2000 ohms.

* * * * *